US005391277A

United States Patent [19]

Weng

[11] Patent Number: 5,391,277

[45] Date of Patent: Feb. 21, 1995

[54] STRUCTURE OF ELECTRO-PLATING BARREL

[76] Inventor: Evans Weng, No. 1, Alley 4, Lane 63, Fu-Hsing Rd., Taipei City, Taiwan, Prov. of China

[21] Appl. No.: 231,508

[22] Filed: Apr. 22, 1994

[51] Int. Cl.[6] ..... C25D 17/20
[52] U.S. Cl. ..... 204/213
[58] Field of Search ..... 204/213, 214

[56] References Cited

U.S. PATENT DOCUMENTS 4,762,281 8/1988 Eberhardt ..... 241/46.06
4,946,573 8/1990 Weng ..... 204/213

*Primary Examiner*—John Niebling
*Assistant Examiner*—Brendan Mee
*Attorney, Agent, or Firm*—Morton J. Rosenberg; David I. Klein

[57] ABSTRACT

An electro-plating barrel, which includes a speed increaser driven by the barrel to turn a impeller vane pump causing it to constantly pump plating solution through the barrel so as to equalize the concentration of the plating solution internally as well as externally.

1 Claim, 4 Drawing Sheets

STRUCTURE OF ELECTRO-PLATING BARREL

BACKGROUND OF THE INVENTION

The present invention relates to an electro-plating barrel, and more particularly to such an electro-plating barrel which uses a speed increaser driven by the barrel to turn a vane pump causing it to pump plating solution into the barrel so as to equalize the concentration of the plating solution internally as well as externally.

U.S. Pat. No. 4,946,573, issued to the present inventor, discloses a pump-attached dipole electro-plating barrel, which includes an impeller vane pump driven by the barrel to constantly pump outside plating solution into the barrel so as to equalize the concentration of the plating solution internally as well as externally. Several electrodes are positioned in the barrel to alternatively connect with with anode and cathode through an electric polarity changing device, so that the metal film which is deposited onto the electrodes during the rotation of temporary cathode can be automatically electrolyzed from the electrodes through the change of electric polarity connection to minimize the consumption of anode metal and metal ion in bath. This structure of electro-plating barrel is functional, however, due to the limitation of the ratio of number of teeth between the end gear portion on the barrel and the driven gear on the impeller vane pump, the revolving speed of the axle of the vane-like member of the impeller vane pump is limited. Therefore the operation efficiency of this structure of electro-plating barrel must be improved.

SUMMARY OF THE INVENTION

The present invention has been accomplished to provide an electro-plating barrel which eliminates the aforesaid drawback. This object is achieved by fastening a socket member to one end of the barrel and installing a speed increaser in the socket member, so that when the barrel is turned by the motor drive, the speed increaser is driven by the socket member to turn the impeller vane pump causing it to pump outside plating solution into the barrel. According to one embodiment of the present invention, the speed increaser comprises an internal gear integrally made around the inside wall of the tubular shell thereof on the inside and driven by the socket member, a plurality of sun and planet gear sets coupled in series and meshed with the internal gear, a first axle and a second axle coupled to the sun and planet gear sets at two opposite ends, wherein the first axle is driven by the sun and planet gear sets to turn the impeller vane pump; the second axle terminates in a square block fitted into a square hole on a constraint member, which is affixed to the inside wall of a holder cap being fastened to the barrel supporting frame.

DETAILED DESCRIPTION OF THE PREFERRED EMBODIMENT

Figure 1:
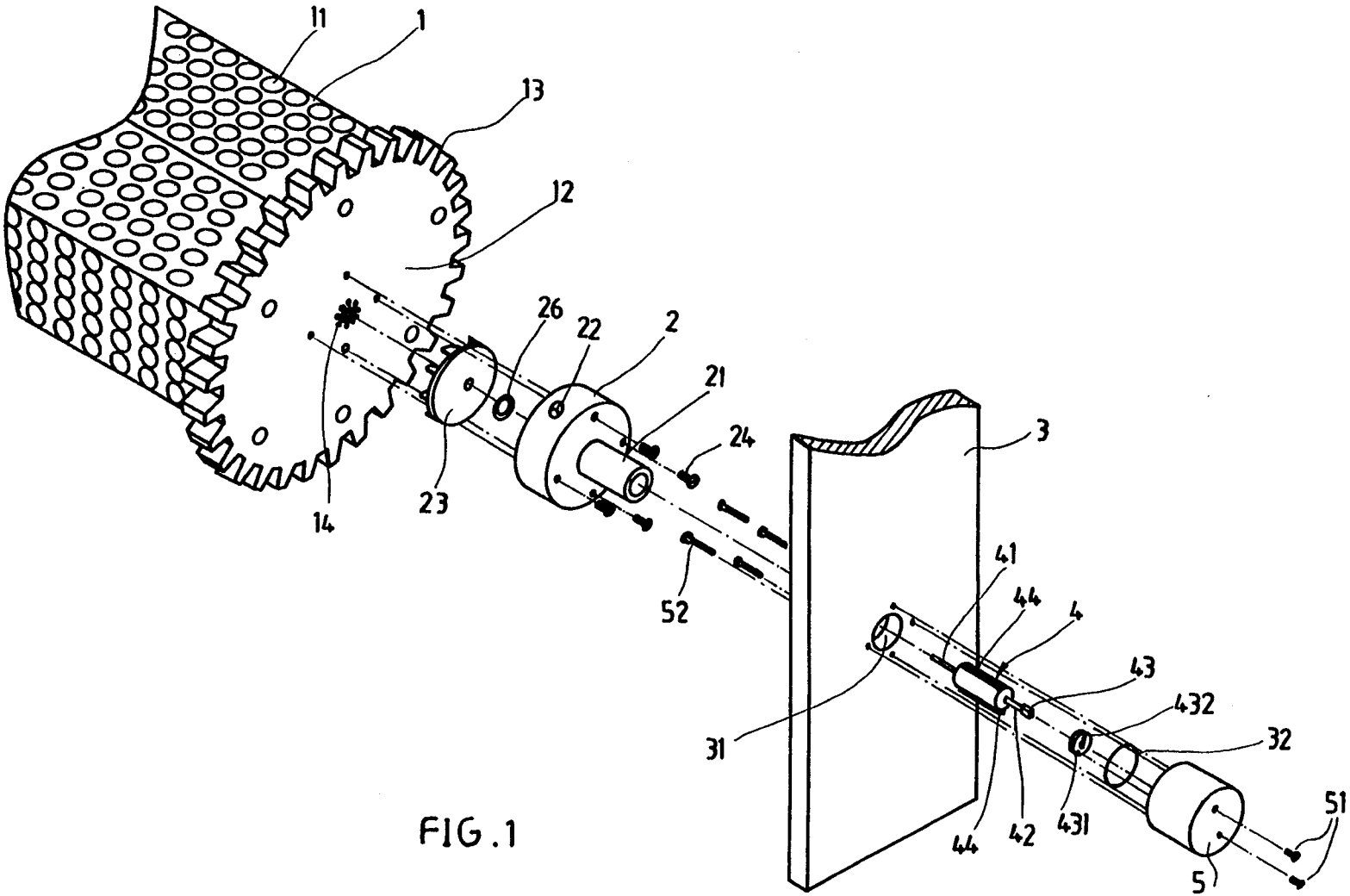
FIG. 1 is an exploded view of the preferred embodiment of the present invention.
Figure 2:
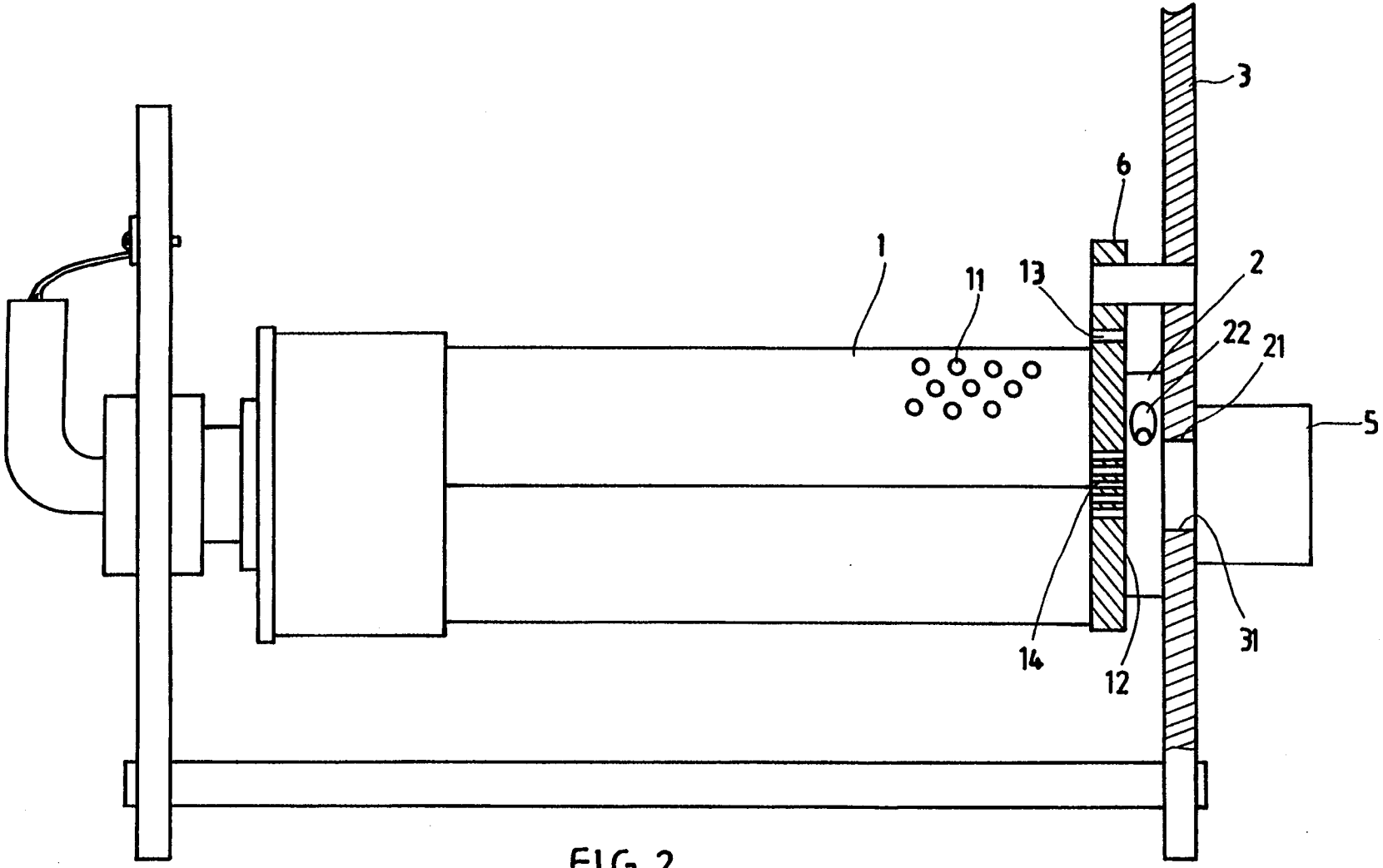
FIG. 2 is a longitudinal view in section of the preferred embodiment of the present invention.
Figure 3:
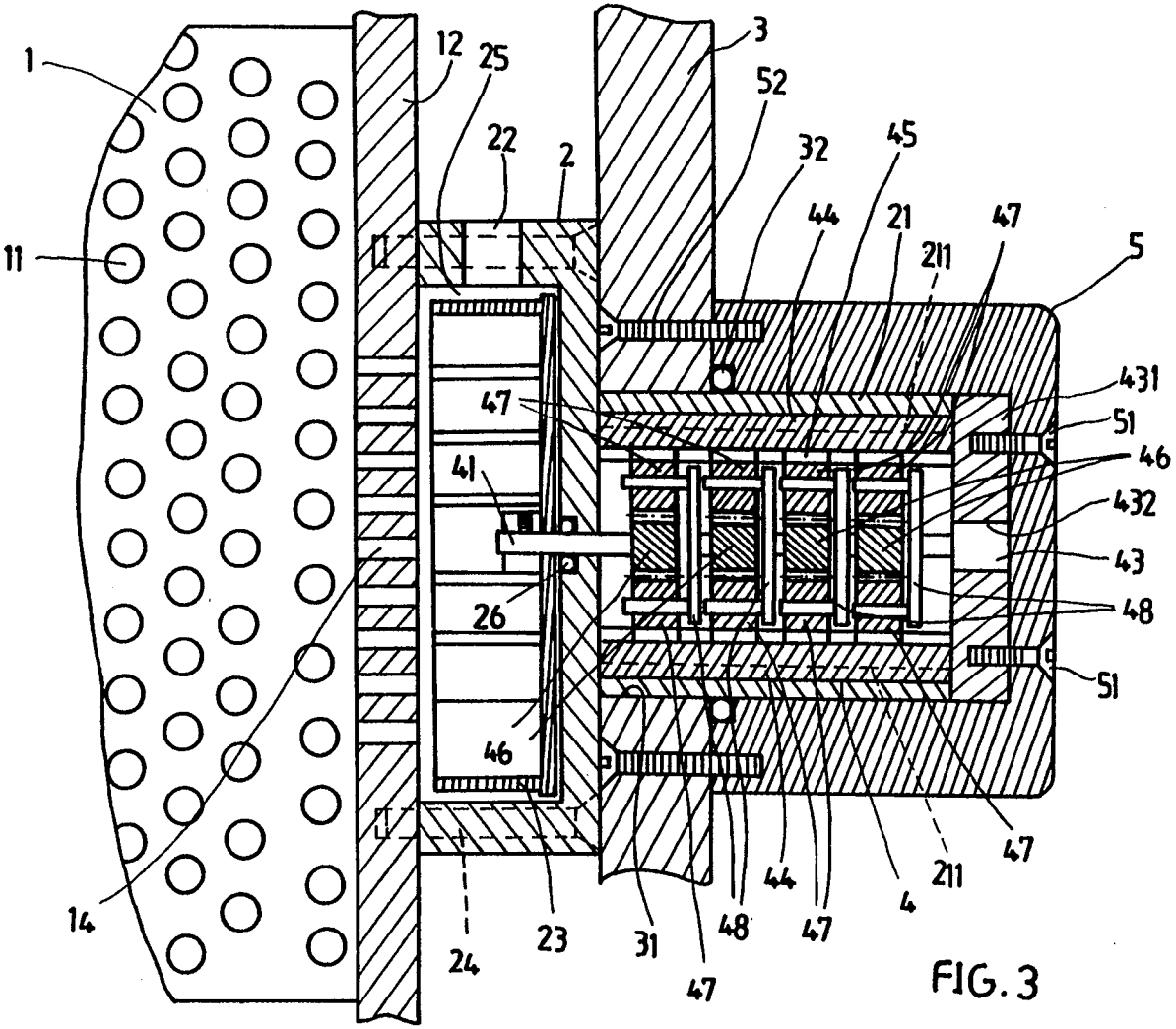
FIG. 3 is a sectional view in an enlarged scale, showing the transmission between the cylinder, the impeller vane pump and the speed increaser according to the present invention.
Figure 4:
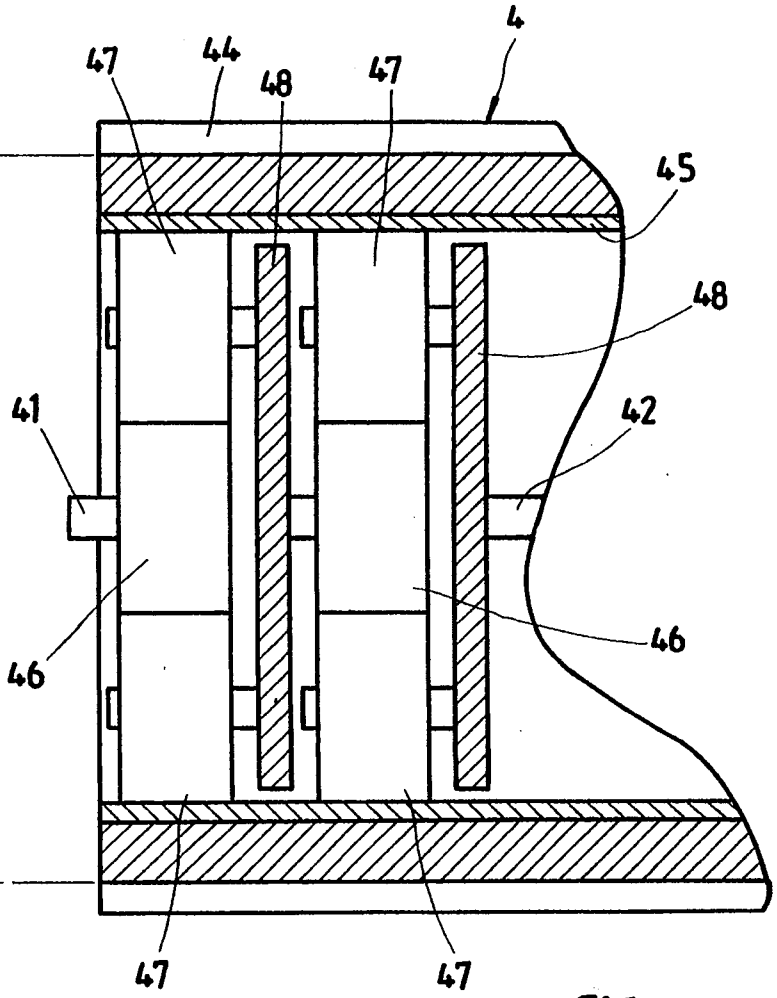
FIG. 4 is a sectional view in an enlarged scale of the speed increaser shown in FIG. 1.
Figure 4A:
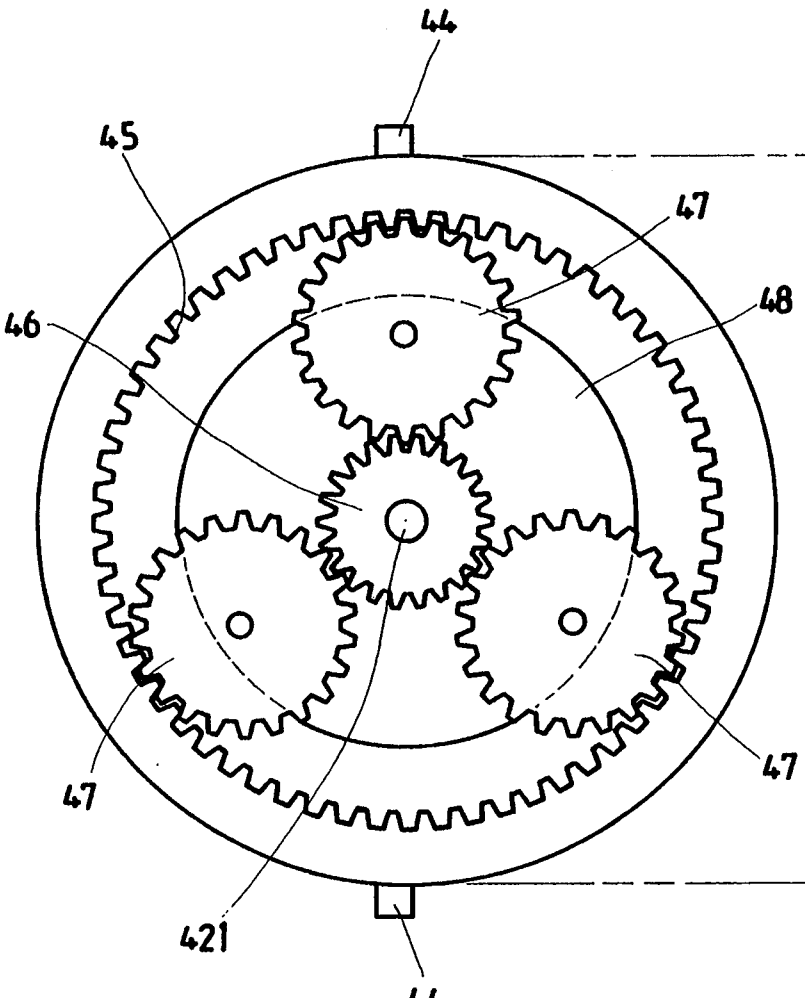
FIG. 4A is an end view in an enlarged scale of the speed increaser shown in FIG. 1.

Referring to FIGS. 1, 2, 3, 4, and 4A, a socket member 2 is fastened to the end gear portion 12 of the cylinder, referenced by 1, by screws 24. The cylinder 1 has holes 11 for circulation of plating solution. The socket member 2 covers over the output port 14 in the center of the end gear portion 12, having a hollow shaft 21 longitudinally disposed in line with the input port 14 on the end gear portion 12 of the barrel 1. The teeth 13 of the end gear portion 12 meshes with a driving gear 6, which is mounted on the output shaft of a motor drive (not shown) An impeller vane pump element 23 is received in the inside chamber 25 of the socket 2. The hollow shaft 21 of the socket member 2 has two longitudinal grooves 211 on the inside wall thereof for mounting a speed increaser 4. The speed increaser 4 has two longitudinal ribs 44 raised from the outside wall thereof at two opposite locations and respectively engaged into the longitudinal grooves 211 on the socket member 2, therefore the speed increaser 4 will turn synchronously when the socket member 2 is rotated. The speed increaser 4 comprises an internal gear 45 integrally made around the inside wall of the tubular shell thereof, a plurality of sun and planet gear sets coupled in series and meshed with the internal gear 45, wherein each sun and planet gear set includes a disk 48, a sun gear 46 spaced from the disk 48, and a plurality of planet gear wheels 47 meshed between the internal gear 45 and the sun gear 46. The gear shaft of the sun gear 46 of one sun and planet gear set is connected to the disk 48 of another, and therefore the sun and planet gear sets are coupled in series. The speed increaser 4 further comprises a first axle 41 at one end and a second axle 42 at an opposite end. The second axle 42 terminates in a square block 43 fitted into a square hole 432 on a constraint member 431. The constraint member 431 is fastened to a holder cap 5 on the inside by screws 51. The first axle 41 of the speed increaser 4 is coupled to the impeller vane pump element 23. A water seal ring 26 is mounted around the first axle 41 to seal the gap. The holder cap 5 is fastened to the frame, referenced by 3, by screws 52. When installed, the hollow shaft 21 of the socket member passes through an axle hole 31 on the frame 3 and externally sealed by a seal ring 32 and is received inside the holder cap 5.

When the driving gear 6 is turned by the motor drive, the cylinder 1 and the socket member 2 are turned, causing the speed increaser 4 to turn the impeller vane pump element 23 at a high speed, and therefore plating solution is pumped by the impeller vane pump element 23 out of the cylinder 1 through the output port 14 and moved out of the outlet 22 on the socket member 2 to further enter the cylinder 1 again through the holes 11.

What is claimed is:

1. An electro-plating barrel of the type having a cylinder with peripheral holes mounted between a first supporting frame and a second supporting frame and a impeller vane pump driven by the barrel to constantly pump plating solution out of said cylinder through an output port thereof for circulation through peripheral holes thereof so as to equalize the concentration of the plating solution internally as well as externally, the improvement comprising a socket member fastened to one end of the perforated cylinder to hold said impeller vane pump on the inside and having a hollow shaft inserted through a hole on said first supporting frame and an outlet for letting inside plating solution be pumped out of said cylinder, a holder cap fastened to said first supporting frame and covered over said hollow shaft of said socket member, a speed increaser received inside said hollow shaft of said socket member and turned by said socket member to rotate said impeller vane pump causing it to pump plating solution into said perforated cylinder, said speed increaser comprising an internal gear integrally made around a tubular shell thereof and driven by said hollow shaft of said socket member, a plurality of sun and planet gear sets coupled in series and meshed with said internal gear, a first axle and a second axle coupled to said sun and planet gear sets at two opposite ends, said first axle being driven by said sun and planet gear sets to turn said impeller vane pump, said second axle terminating in a square block fitted into a square hole on a constraint member being affixed to an inside wall of said holder cap.

* * * * *